US009437068B2

(12) United States Patent
Xiao et al.

(10) Patent No.: US 9,437,068 B2
(45) Date of Patent: Sep. 6, 2016

(54) CASH REPLENISHMENT METHOD FOR FINANCIAL SELF-SERVICE EQUIPMENT

(71) Applicant: GRG Banking Equipment Co., Ltd., Guangzhou, Guangdong (CN)

(72) Inventors: Dahai Xiao, Guangzhou (CN); Qinghua Wang, Guangzhou (CN); Weiping Xie, Guangzhou (CN); Juanmiao Zhang, Guangzhou (CN); Jixing Tan, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/421,134

(22) PCT Filed: Apr. 2, 2013

(86) PCT No.: PCT/CN2013/073633

§ 371 (c)(1),
(2) Date: Feb. 11, 2015

(87) PCT Pub. No.: WO2014/056309

PCT Pub. Date: Apr. 17, 2014

(65) Prior Publication Data

US 2015/0206371 A1 Jul. 23, 2015

(30) Foreign Application Priority Data

Oct. 9, 2012 (CN) ..... 2012 1 0380380

(51) Int. Cl.
*G07D 13/00* (2006.01)
*G07D 11/00* (2006.01)

(52) U.S. Cl.
CPC ..... *G07D 11/0057* (2013.01); *G07D 11/0072* (2013.01); *G07D 11/0054* (2013.01)

(58) Field of Classification Search
CPC . G07D 7/00; G07D 11/0054; G07D 11/0072
USPC ..... 194/216, 217; 209/534; 235/379
See application file for complete search history.

(56) References Cited

U.S. PATENT DOCUMENTS 3,760,158 A 9/1973 Whitehead et al.
5,173,590 A 12/1992 Nakano et al.

(Continued)

FOREIGN PATENT DOCUMENTS

CN 1409244 A 4/2003
CN 101377870 A 3/2009

(Continued)

OTHER PUBLICATIONS

International Search Report dated Jun. 27, 2013 from corresponding International Application No. PCT/CN2013/073633, (3 pages).

(Continued)

*Primary Examiner* — Mark Beauchaine
(74) *Attorney, Agent, or Firm* — Wolf, Greenfield & Sacks, P.C.

(57) ABSTRACT

A cash replenishment method for financial self-service equipment. The method comprises: by using a general solution method for directly solving an integral solution of a linear equation with n unknowns, obtaining a general solution formula of the integral solution of the linear equation with n unknowns; then, in accordance with a principle that the cash replenishment amount of each denomination must be greater than zero and less than the number of remaining available banknotes of this denomination in self-service equipment, solving a limiting range of free factors in the general solution formula, so that all cash replenishment solutions are obtained; and lastly, in accordance with a cash replenishment principle of a self-service equipment system, obtaining an optimal cash replenishment solution. The cash replenishment method can find out all cash replenishment solutions without using an exhaustive attack method, and can achieve rapid and highly-efficient cash replenishment.

13 Claims, 4 Drawing Sheets

(56) References Cited

U.S. PATENT DOCUMENTS

| | | | | |
|---|---|---|---|---|
| 2002/0198839 | A1 | 12/2002 | Uozumi et al. | |
| 2004/0011621 | A1 | 1/2004 | Olbrich | |
| 2009/0301946 | A1 | 12/2009 | Razzaboni et al. | |
| 2011/0259706 | A1* | 10/2011 | Aas | G07F 19/00 194/206 |

FOREIGN PATENT DOCUMENTS

| | | | |
|---|---|---|---|
| CN | 101763684 | A | 6/2010 |
| CN | 102096965 | A | 6/2011 |
| CN | 202058233 | U | 11/2011 |
| CN | 102306366 | A | 1/2012 |
| CN | 102903176 | A | 1/2013 |
| CN | 102903177 | A | 1/2013 |
| EP | 0100962 | A2 | 7/1983 |
| EP | 0100962 | B1 | 2/1991 |
| EP | 0851394 | A1 | 7/1998 |
| EP | 1 271 425 | A2 * | 1/2003 ..... G07D 11/00 |
| EP | 1271425 | A2 | 1/2003 |
| GB | 2279796 | A | 1/1995 |
| GB | 2476065 | A | 6/2011 |
| JP | 2006048117 | A | 2/2006 |

OTHER PUBLICATIONS

International Search Report dated Jul. 18, 2013 from potentially related International Application No. PCT/CN2013/073649, (3 pages).

He, Jia'Bing et al., *Research and Development of Banknote Sorter System,* (2007)(5 pages).

Extended European search reported, dated Sep. 28, 2015, from corresponding European Application No. 13846086.0, (6 pages).

* cited by examiner

CASH REPLENISHMENT METHOD FOR FINANCIAL SELF-SERVICE EQUIPMENT

This application claims priority to Chinese patent application No. 201210380380.7 titled "METHOD FOR FINANCIAL SELF-SERVICE EQUIPMENT TO DISPENSE BANKNOTES" and filed on with the State Intellectual Property Office on Oct. 9, 2012 which is incorporated herein by reference in its entirety.

FIELD OF THE INVENTION

The present invention relates to the technique field of financial self-service terminal transaction, and in particular to a method for a financial self-service equipment to dispense banknotes.

BACKGROUND OF THE INVENTION

Dispensing banknotes of a financial self-service equipment refers to coordinately dispensing banknotes with different denominations in different banknote-boxes in an automatic teller machine (ATM).

A financial self-service equipment is provided with at least one banknote-box, and supports at least one denomination. Each banknote-box is filled with a certain number of banknotes with the same denomination. When outputting banknotes, it needs to dispense various denominations according to a user's input amount of banknotes. While satisfying the requirement of the user, banknotes reloading and maintenance also should be considered. Therefore, for each time of dispensing banknotes before outputting banknotes, it is necessary to make a comprehensive consideration for banknote dispensing according to an amount input by the user and the remaining available banknotes in the banknote-box.

In an existing banknote-dispensing method for a self-service equipment, an exhaustive search is performed to find all banknote-dispensing schemes according to an amount input by a user and denominations provided in an ATM; then all practicable banknote-dispensing schemes are selected in conjunction with the amount of remaining available banknotes in the ATM; and further, a best scheme from the practicable banknote-dispensing schemes is selected according to a banknote-dispensing principle.

However, in the case of many denominations in a self-service equipment, it needs a long time for the self-service equipment to calculate all the banknote-dispensing schemes. The more the denominations in the self-service equipment are, the longer the calculating time is. Thus, there is a problem with long banknote-dispensing time and low banknote-dispensing efficiency in the existing banknote-dispensing methods.

Therefore, how to reduce the banknote-dispensing time and improve the banknote-dispensing efficiency is the most necessary problem to be solved.

SUMMARY OF THE INVENTION

In view of the above, the objective of the present invention is to provide a method for a financial self-service equipment to dispense banknote, so as to reduce the banknote-dispensing time and improve the banknote-dispensing efficiency.

An embodiment according to the present invention is achieved as follows:

a method for a financial self-service equipment to dispense banknotes is disclosed, and the method includes:

acquiring a total dispensing amount input by a user;

acquiring denomination values of available banknotes in the self-service equipment;

acquiring the number of available banknotes corresponding to each denomination value;

determining a total available amount in the self-service equipment according to the denomination values and the number of available banknotes;

establishing a relation between the denomination values, the number of available banknotes corresponding to each denomination value and the total dispensing amount that is represented by the following equation:

$$\sum_{i=1}^{n} A_i X_i = M,$$

in the case where the total available amount is not less than the total dispensing amount and the greatest common divisor of denomination values available in the self-service equipment can divide the total dispensing amount with no remainder, where $A_i$ is the several denomination values, $X_i$ is an unknown number of banknotes to be output corresponding to $A_i$, n is a total number of the denomination value types and is not less than 2, and M is the total dispensing amount;

dividing both sides of the equation $$\sum_{i=1}^{n} A_i X_i = M$$

by the greatest common divisor of the n denomination values, $\gcd(A_1, A_2 \ldots A_n)$, synchronously in the case where $\gcd(A_1, A_2 \ldots A_n)$ is not 1, to obtain a linear indeterminate equation with integer coefficients and n unknowns, $$\sum_{i=1}^{n} a_i X_i = m,$$

where $a_i$ is a quotient from dividing $A_i$ by $\gcd(A_1, A_2 \ldots A_n)$ and m is a quotient from dividing M by $\gcd(A_1, A_2 \ldots A_n)$;

calculating a general solution of the linear indeterminate equation with integer coefficients and n unknowns:

$$\sum_{i=1}^{n} a_i X_i = m$$

as $$\begin{cases} X_1 = X_{01}[m - (a_3 X_3 + \ldots + a_n X_n)] + a_2 t \\ X_2 = X_{02}[m - (a_3 X_3 + \ldots + a_n X_n)] - a_1 t \end{cases},$$

where t, $x_3$, $x_4$, . . . $x_n \in Z$ and $\gcd(a_1, a_2)=1$;

calculating a particular solution $(X_{01}, X_{02})$;

calculating out a set of all t satisfying $0 \le X_1 \le S_1$, $0 \le X_2 \le S_2$ . . . $0 \le X_n \le S_n$ according to the general solution of $$\sum_{i=1}^{n} a_i X_i = m$$

and the particular solution of $$\sum_{i=1}^{n} a_i X_i = m:$$

($X_{01}$, $X_{02}$), where $S_1$, $S_2$ . . . $S_n$ are the numbers of the available banknotes corresponding to the denomination values;

determining the value range of t in set A according to a preset banknote-dispensing principle corresponding to $X_1$, $X_2$ . . . $X_n$; and substituting t in the general solution above by an integral t to calculate out the values of $X_1$, $X_2$ . . . $X_n$, and outputting $X_1$, $X_2$ . . . $X_n$ numbers of banknotes with the denomination values $A_1$, $A_2$ . . . $A_n$ by the self-service equipment.

Preferably, in the case where the number of the available denomination values in the self-service equipment is not less than 3, and $a_1$ and $a_2$ are not relatively prime numbers, before calculating the general solution of $$\sum_{i=1}^{n} a_i X_i = m,$$

the method further includes:

converting the linear indeterminate equation with integer coefficients and n unknowns:

$$\sum_{i=1}^{n} a_i X_i = m$$

into an equivalent linear equation with n unknowns: $a_1X_1+a_2X_2=m-(a_3X_3+\ldots+a_nx_n)$, where one particular solution of $$a_1X_1 + a_2X_2 = 1$$

is $$\begin{cases} X_{01} \\ X_{02} \end{cases} \text{ and } gcd(a_1, a_2) = 1.$$

Preferably, the preset banknote-dispensing principle is an average method.

Preferably, the preset banknote-dispensing principle is an average-emptying method.

Preferably, the preset banknote-dispensing principle is a number minimum method.

Preferably, the preset banknote-dispensing principle is a maximum-denomination priority method.

Preferably, the preset banknote-dispensing principle is a minimum-denomination priority method.

Preferably, if the total available amount is less than the total dispensing amount or there is no integral t, the method further includes:

acquiring available denomination values and the number of banknotes corresponding to each available denomination value of other self-service equipments connected to a network, via a database by the self-service equipment;

determining a specific address of a self-service equipment that conforms to a preset condition where the total available amount is not less than the total dispensing amount or there is an integral t; and displaying the specific address.

Compared with the prior art, the technical scheme provided in the embodiment has advantages and features as follows:

in the scheme provided in the present invention, a general solution method is obtained by calculating the integer solution of the linear equation with n unknowns directly; then a restriction range of a free factor in the general solution above is calculated according to that the dispensing amount of each denomination has to be greater than zero and less than the number of the available banknotes with the denomination in the self-service equipment; thereby the number of all banknote-dispensing schemes is obtained quickly; and an optimized banknote-dispensing scheme is finally obtained based on a banknote-dispensing principle of the self-service equipment system finally. The method provided in the present invention has advantages of direct-viewing, high-efficiency, speediness and preciseness, and all banknote-dispensing schemes can be found quickly without using the exhaustive search.

BRIEF DESCRIPTION OF THE DRAWINGS

The accompany drawings needed to be used in the description of the embodiments or the prior art will be described briefly as follows, so that the technical schemes according to the present invention or according to the prior art will become more clearer. It is obvious that the accompany drawings in the following description are only some embodiments of the present invention. For those skilled in the art, other accompany drawings may be obtained according to these accompany drawings without any creative work.

DETAILED DESCRIPTION OF THE INVENTION

The technical scheme according to the embodiments of the present invention will be described clearly and completely as follows in conjunction with the accompany drawings in the embodiments of the present invention. It is obvious that the described embodiments are only a part of the embodiments according to the present invention. All the other embodiments obtained by those skilled in the art based on the embodiments in the present invention without any creative work belong to the scope of the present invention.

A method for a financial self-service equipment to dispense banknotes is provided in an embodiment according to the present invention, so as to reduce the banknote-dispensing time and improve the banknote-dispensing efficiency. As there are several manners for specifically implementing of the above method for a financial self-service equipment to dispense banknotes, the method will be described in detail with specific embodiments in the following.

Figure 1:
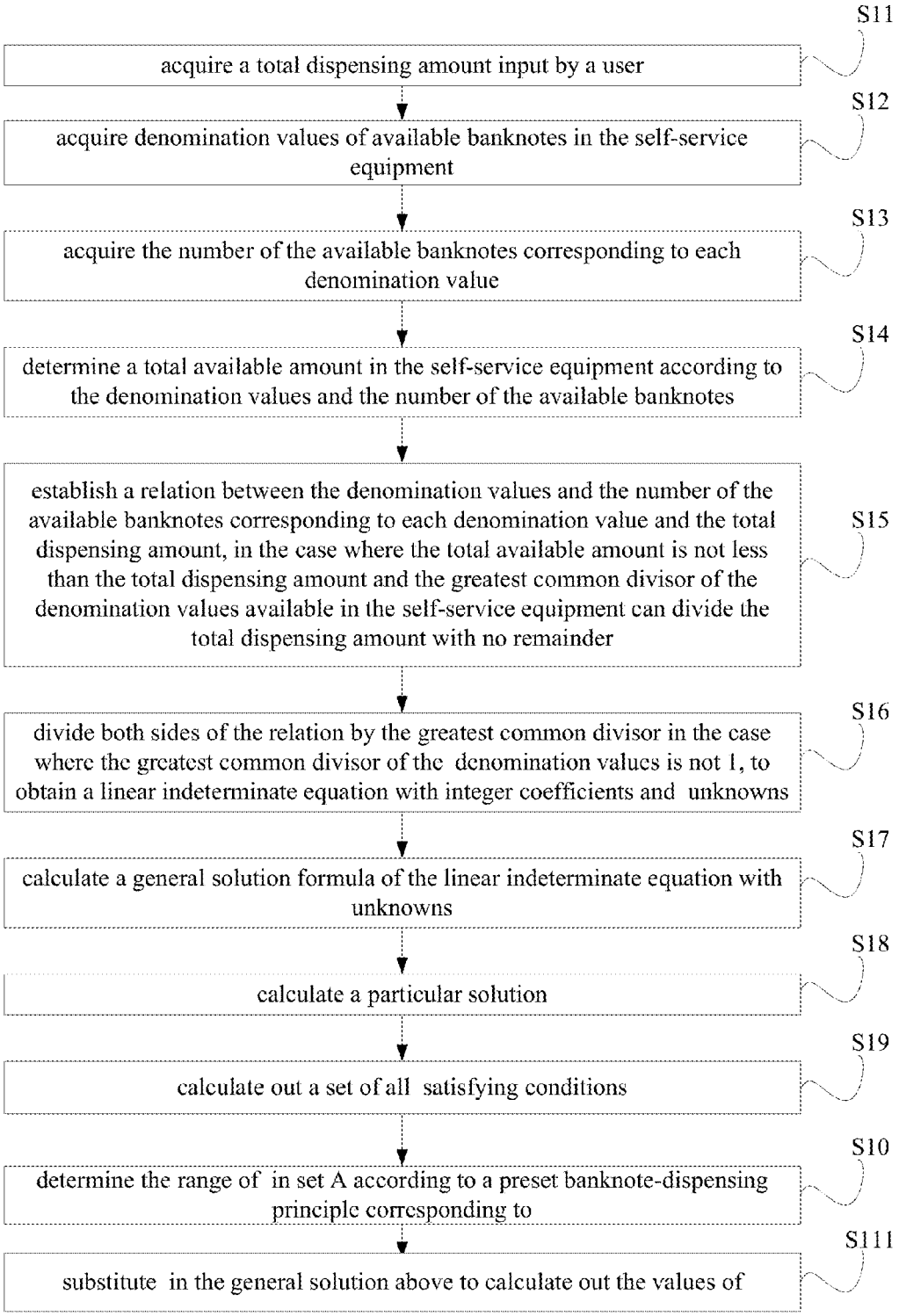
FIG. 1 shows a method for a financial self-service equipment to dispense banknotes according to the present invention.

Referring to FIG. 1, which shows a method for a financial self-service equipment to dispense banknotes, the method includes the following steps of S11-S111.

Step S11, acquiring a total dispensing amount input by a user.

Specifically, the total dispensing amount is an amount to be output after the self-service equipment finishes a matching on the user, that is, a user-demanded amount. For example, the user inputs 200 Yuan.

Step S12, acquiring denomination values of available banknotes in the self-service equipment.

Specifically, the denomination value is a denomination of a banknote. For example, there are a 100 Yuan banknote, a 50 Yuan banknote and a 10 Yuan banknote in the self-service equipment.

Step S13, acquiring the number of available banknotes corresponding to each denomination value.

Specifically, the number of available banknotes is the actual available number of banknotes. For example, there are 10 pieces of 100 Yuan banknotes, 20 pieces of 50 Yuan banknotes and 20 pieces of 10 Yuan banknotes in the self-service equipment.

Step S14, determining a total available amount in the self-service equipment according to the denomination values and the number of available banknotes;

Specifically, the total available amount is an amount of all banknotes. For example, the total available amount=100 Yuan×10+50 Yuan×20+10 Yuan×2=2220 Yuan.

Step S15, establishing a relation between the denomination values, the number of available banknotes corresponding to each denomination value and the total dispensing amount that is represented by the following equation:

$$\sum_{i=1}^{n} A_i X_i = M,$$

in the case where the total available amount is not less than the total dispensing amount and the greatest common divisor of the available denomination values in the self-service equipment can divide the total dispensing amount with no remainder, where $A_i$ is the multiple denomination values, $X_i$ is an unknown number of banknotes to be output corresponding to $A_i$, n is a total number of the denomination value types and is not less than 2, and M is the total dispensing amount.

Specifically, the objective of establishing the relation $$\sum_{i=1}^{n} A_i X_i = M$$

is to calculate the needed number for each denomination value hereafter.

Step S16, dividing both sides of the equation $$\sum_{i=1}^{n} A_i X_i = M$$

by the greatest common divisor of the n denomination value types: $\gcd(A_1, A_2 \ldots A_n)$, if $\gcd(A_1, A_2 \ldots A_n)$ is not 1, to obtain an linear indeterminate equation with integer coefficients and n unknowns, $$\sum_{i=1}^{n} a_i X_i = m,$$

where $a_i$ is the quotient from dividing $A_i$ by $\gcd(A_1, A_2 \ldots A_n)$ and m is the quotient from dividing M by $\gcd(A_1, A_2 \ldots A_n)$.

Step S17, calculating a general solution of the linear indeterminate equation with integer coefficients and n unknowns $$\sum_{i=1}^{n} a_i X_i = m \text{ as } \begin{cases} X_1 = X_{01}[m - (a_3 X_3 + \ldots + a_n X_n)] + a_2 t \\ X_2 = X_{02}[m - (a_3 X_3 + \ldots + a_n X_n)] - a_1 t \end{cases},$$

where t, $x_3, x_4, \ldots, x_n \in Z$ and $\gcd(a_1, a_2)=1$.

Step S18, calculating a particular solution $(X_{01}, X_{02})$.

Step S19, calculating out a set of all t satisfying $0 \le X_1 \le S_1$, $0 \le X_2 \le S_2 \ldots 0 \le X_n \le S_n$ according to the general solution of $$\sum_{i=1}^{n} a_i X_i = m$$

and the particular solution of $$\sum_{i=1}^{n} a_i X_i = m:$$

$(X_{01}, X_{02})$, where $S_1, S_2 \ldots S_n$ are the numbers of the available banknotes corresponding to the denomination values.

Step S10, determining the range of t in set A according to a preset banknote-dispensing principle corresponding to $X_1, X_2 \ldots X_n$.

Step S111, in the case that there is an integral t, substituting t in the general solution above to calculate out the values of $X_1, X_2 \ldots X_n$, and outputting $X_1, X_2 \ldots X_n$ numbers of banknotes with the denomination values $A_1, A_2 \ldots A_n$ by the self-service equipment.

In the embodiment shown in FIG. 1, a general solution method is obtained by calculating the integral solution of the linear equation with n unknowns directly; then a restriction range of a free factor in the general formula is calculated according to that the dispensing amount of each denomination has to be greater than zero and less than the number of the available banknotes with the denomination in the self-service equipment; thereby the number of all banknote-dispensing schemes is obtained quickly; and an optimized banknote-dispensing scheme is finally obtained based on a banknote-dispensing principle of the self-service equipment system. The method provided in the present invention has advantages of direct-viewing, high-efficiency, speediness and preciseness, and all banknote-dispensing schemes can be found quickly without using the exhaustive search.

In the embodiment shown in FIG. 1, if the total available amount is less than the total dispensing amount or there is no integral t, the method may further includes the following steps:

acquiring available denomination values and the number of banknotes corresponding to each available denomination value of other self-service equipments connected to a network, via a database by the self-service equipment;

determining a specific address of a self-service equipment that conforms to a preset condition where the total available amount is not less than the total dispensing amount or there is an integral t; and displaying the specific address.

Specifically, the objective of displaying other self-service equipments connected to the network on the self-service equipment is to enable the user to dispense banknotes on other self-service equipments.

The technical scheme provided in the present invention is introduced briefly in the above and will be described in detail with specific embodiments in the following.

First Embodiment

Figure 2:
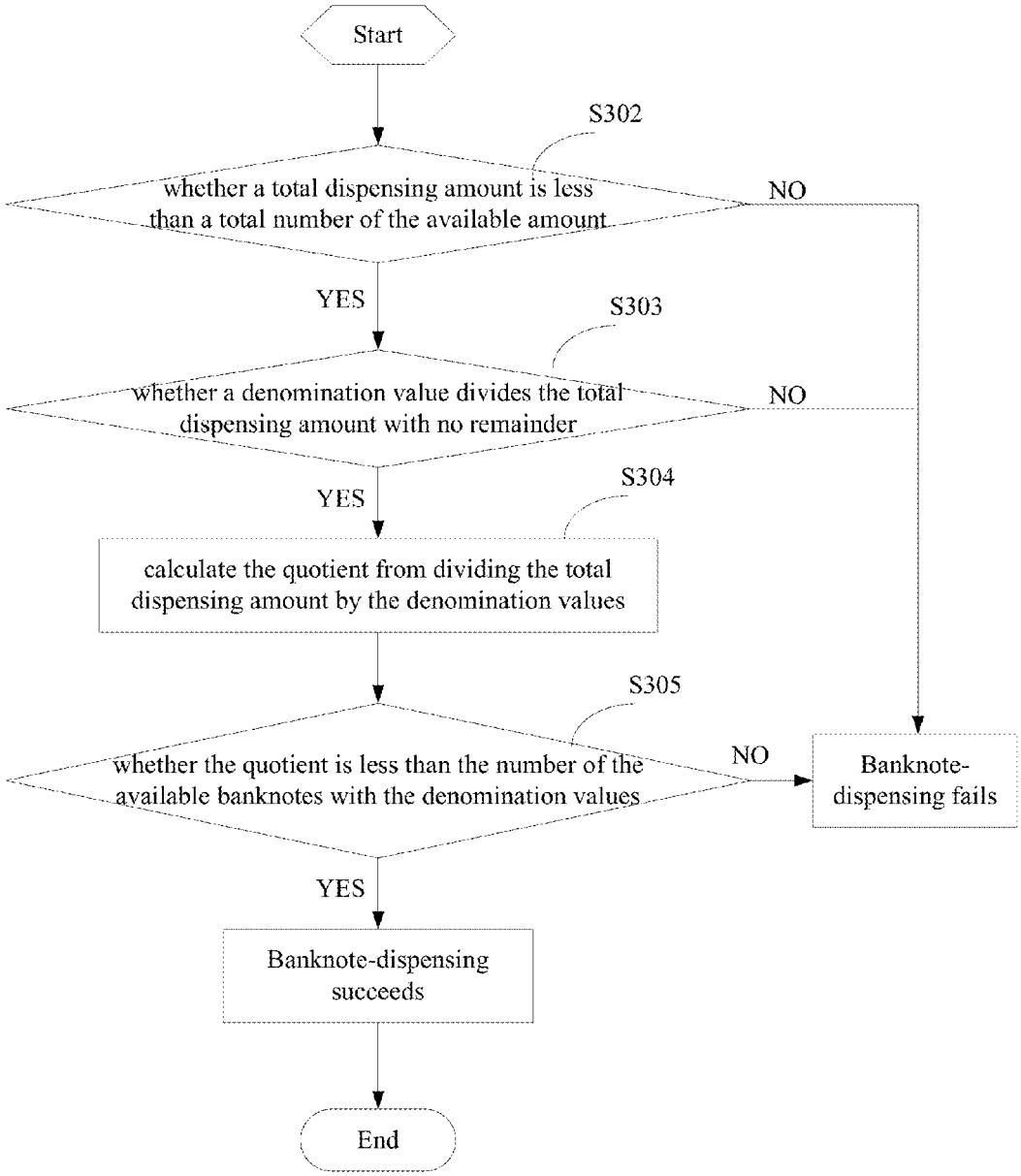
FIG. 2 is a flowchart of a banknote-dispensing algorithm in a case of one denomination according to the present invention.

Referring to FIG. 2, it shows a whole banknote-dispensing process of a self-service equipment in the case where only one denomination value is available in the self-service equipment. Since one denomination value does not relate to the calculation of an equation with n unknowns, the first embodiment is described simply herein.

S302: judging whether a dispensing amount is not greater than a total number of available amount in banknote-boxes of the self-service equipment, if yes, proceeding to step S303; otherwise, the banknote-dispensing fails and the process ends.

S303: judging whether the denomination value can divide an amount input by a user with no remainder, if yes, proceeding to step S304; otherwise, the banknote-dispensing fails and the process ends.

S304: judging whether the quotient from dividing the user-input amount by the denomination value with no remainder is less than the number of available banknotes with the denomination, if yes, the banknote-dispensing succeeds and the banknote-dispensing result is the quotient; otherwise the banknote-dispensing fails and the process ends.

For the first embodiment, there is only one denomination. For example: suppose that only one denomination of 50 is provided in the self-service equipment and only 13 numbers of banknotes are available. If the user-input amount is 540, the banknote-dispensing fails due to that $540\%50=40\neq0$; if the user-input amount is 750, although $750\%50=0$, the banknote-dispensing also fails due to that $750/50=15>13$; if the user-input amount is 550, the banknote-dispensing succeeds since $550\%50=0$ and $550/50=11\leq13$, and the equipment may output the banknotes. Since there is only one denomination, it is not necessary to distinguish the banknote-dispensing principle.

Second Embodiment

Figure 3:
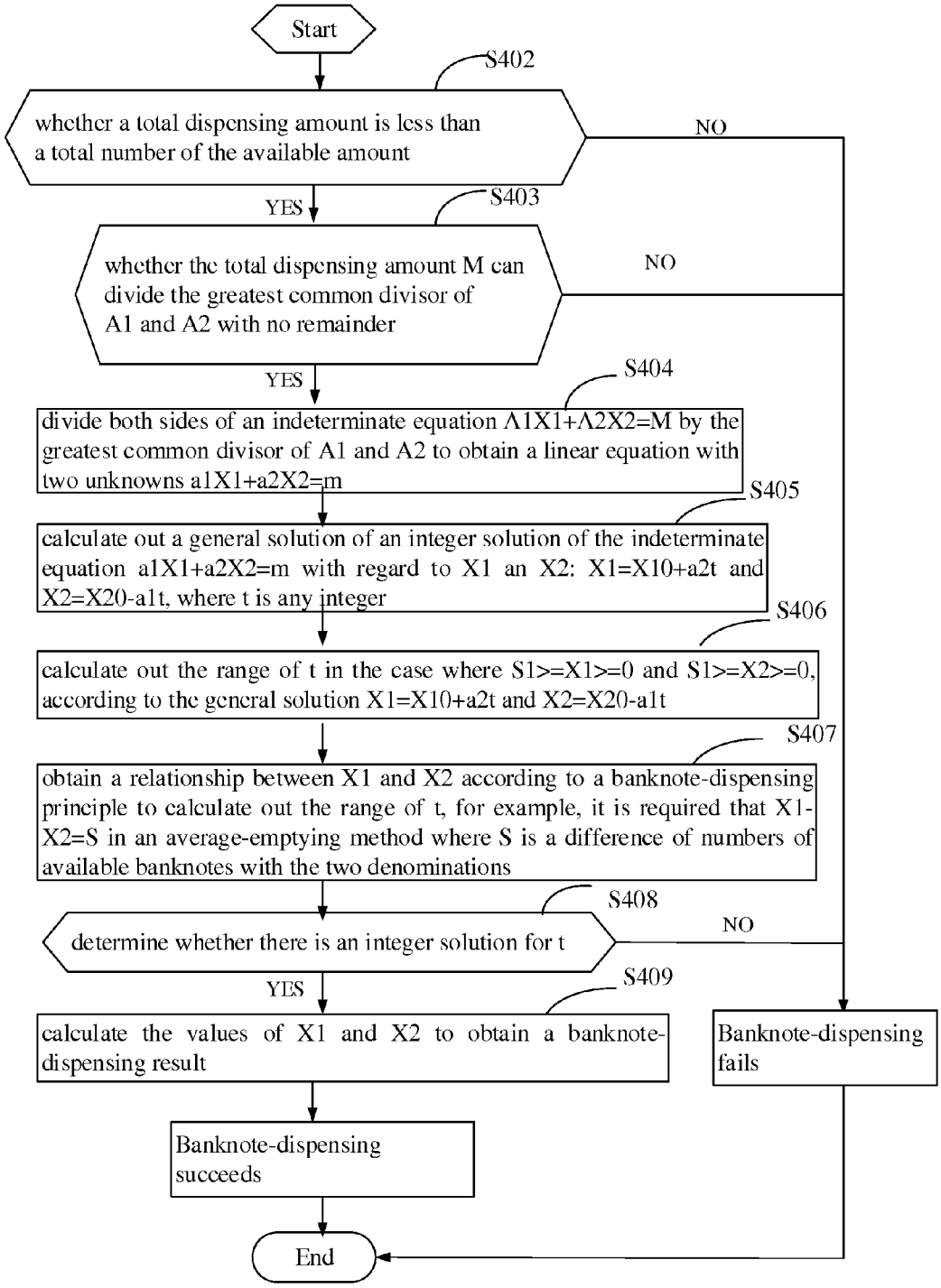
FIG. 3 is a flowchart of a banknote-dispensing algorithm in a case of two denominations according to the present invention.

Referring to FIG. 3, it shows a whole banknote-dispensing process of a self-service equipment in the case where there are two denomination values in the self-service equipment.

S402: judging whether a dispensing amount is not less than a total number of available amount in banknote-boxes of the self-service equipment, if yes, proceeding to S403; otherwise, the banknote-dispensing fails and the process ends.

S403: calculating the greatest common divisor $\gcd(A_1, A_2)$ of the two denomination values and judging whether $\gcd(A_1, A_2)$ can divide the dispensing amount with no remainder, if yes, proceeding to step S404; otherwise, the banknote-dispensing fails and the process ends.

S404: judging whether $\gcd(A_1, A_2)$ is greater than 1, if yes, dividing both sides of $A_1X_1+A_2X_2=M$ by $\gcd(A_1, A_2)$ to obtain an indeterminate equation with integer coefficients and two unknowns: $a_1X_1+a_2X_2=m$, where $\gcd(a_1,a_2)=1$ and $M=m\gcd(A_1, A_2)$; otherwise, keeping $A_1X_1+A_2X_2=M$ as it is.

S405: calculating the indeterminate equation with integer coefficients and two unknowns: $a_1X_1+a_2X_2=m$, where a general solution formula of $\gcd(a_1,a_2)=1$ is $X_1=X_{01}+a_2t$ and $X_2=X_{02}-a_1t$, t is an integral free variable, $(X_{01}, X_{02})$ is one particular solution of $a_1X_1+a_2X_2=m$, and the method for calculating the particular solution is:

1) establishing a matrix $$A=\begin{bmatrix}1 & 0 & a_1\\ 0 & 1 & a_2\end{bmatrix};$$

2) performing an matrix elementary row transformation on the matrix $$A=\begin{bmatrix}1 & 0 & a_1\\ 0 & 1 & a_2\end{bmatrix},$$

and the method for elementary row transforming is:

2a) multiplying elements of a certain row of the matrix by one nonzero integer to obtain a new row;

2b) multiplying elements of a certain row of the matrix by an integer k ($k\neq0$) and adding the multiplied result to corresponding elements of another row of the matrix to obtain a new row.

3) converting the matrix $$A=\begin{bmatrix}1 & 0 & a_1\\ 0 & 1 & a_2\end{bmatrix}$$

into $$B=\begin{bmatrix}1 & 0 & a_1\\ 0 & 1 & a_2\\ ggg & ggg & ggg\\ ggg & ggg & ggg\\ d & e & r\\ \frac{dm}{r} & \frac{em}{r} & m\end{bmatrix},$$

after subjecting $$A=\begin{bmatrix}1 & 0 & a_1\\ 0 & 1 & a_2\end{bmatrix}$$

to the elementary row transformation, in which $(r|m)$;

One of linear combination methods is obtaining a remainder by using a Euclidean algorithm. Since $a_1$ and $a_2$ are relatively prime, it is impossible of the remainder of Euclidean algorithm to be zero. Let $a_1>a_2$, then $a_1$ may be represented as $a_1=k_1a_2+r_1(r_1<a_2)$, if $r_1\neq 1$, $a_2$ may be represented as $a_2=k_2r_1+r_2$ $(r_2<r_1)$, and if $r_2\neq 1$, continuing to do the above representation until $r_i=1$.

For example, $$\begin{bmatrix}1&0&9\\0&1&4\end{bmatrix}\rightarrow\begin{bmatrix}1&0&9\\0&1&4\\1&-1&5\end{bmatrix}\rightarrow\begin{bmatrix}1&0&9\\0&1&4\\1&-1&5\\1&-2&1\end{bmatrix}\rightarrow\begin{bmatrix}1&0&9\\0&1&4\\1&-1&5\\1&-2&1\\m&-2m&m\end{bmatrix}.$$

4) one particular solution of $a_1X_1+a_2X_2=m$ may be obtained as $$\left(X_{01}=\frac{dm}{r},\ X_{02}=\frac{em}{r}\right).$$

5) taking $$X_{01}=\frac{dm}{r}$$

into $X_1=X_{01}+a_2t$ and taking $$X_{02}=\frac{em}{r}$$

into $X_2=X_{02}-a_1t$ to obtain $$X_1=\frac{dm}{r}+a_2t \text{ and } X_2=\frac{em}{r}-a_1t.$$

S406: calculating the range of t, $[t_1, t_2]$, from $$X_1=\frac{dm}{r}+a_2t \text{ and } X_2=\frac{em}{r}-a_1t,$$

according to $0\leq X_1\leq S_1$, $0\leq X_2\leq S_2$ ($S_1$ and $S_2$ are numbers of the available banknotes with the two denomination values).

S407: further limiting values of $X_1$ and $X_2$ according to a banknote-dispensing principle, where the value of t in the range $[t_1, t_2]$ may be determined under the following cases according to different banknote-dispensing principles:

S41) an average method, where $X_1\approx X_2$, that is, $$\frac{dm}{r}+a_2t\approx\frac{em}{r}-a_1t;$$

S42) an average-emptying method, where $X_1-X_2\approx S_1-S_2$;

S43) an minimum-piece-number method, where $(X_1+X_2)$ is as small as possible;

S44) an minimum-denomination priority method, where $X_2$ is as great as possible and taken a maximum value if $A_1>A_2$; otherwise, $X_1$ is as great as possible and taken the maximum value;

S45) maximum-denomination priority method, where $X_1$ is as great as possible and taken a maximum value if $A_1>A_2$; otherwise, $X_2$ is as great as possible and taken a maximum value;

S408: if there is an integral t to satisfy $$\frac{dm}{r}+a_2t\approx\frac{em}{r}-a_1t,$$

values of $X_1$ and $X_2$ may be calculated according the value of t, the banknote-dispensing succeeds and the process ends; otherwise, the banknote-dispensing fails and the process ends.

In the embodiment shown in FIG. 3, an essence of calculating one particular solution of the linear indeterminate equation with integer coefficients and two unknowns $a_1X_1+a_2X_2=m$ is to find out integers $x_{10}$ and $x_{20}$, so as to make the linear combination of $a_1$ and $a_2$ be $a_1x_{10}+a_2x_{20}=m$.

The matrix elementary row transformation may be used:

(1) multiplying elements of a certain row of the matrix by one nonzero integer to obtain a new row;

(2) multiplying elements of a certain row of the matrix by an integer k ($k\neq 0$) and adding the multiplied result to corresponding elements of another row of the matrix to obtain a new row.

The matrix $$A=\begin{bmatrix}1&0&a_1\\0&1&a_2\end{bmatrix}$$

is converted into a matrix $$B=\begin{bmatrix}1&0&a_1\\0&1&a_2\\ggg&ggg&ggg\\ggg&ggg&ggg\\d&e&r\\\frac{dm}{r}&\frac{em}{r}&m\end{bmatrix},$$

where (r|m), by using the above matrix elementary row transformation.

A key of calculating B is to find out r by linear combining $a_1$ and $a_2$ repeatedly where r is the divisor of m, and the divisor here includes a positive divisor and a negative divisor.

In the embodiment shown in FIG. 3, for example, suppose that there are two denominations: 50 and 20 provided in the self-service equipment and there are 12 pieces of 50 Yuan banknotes and 10 pieces of 20 Yuan banknotes available, that is, $A_1=50$, $A_2=20$, $S_1=12$, $S_2=10$.

If a user-input amount is 545, the banknote-dispensing fails since the greatest common divisor of both denomination values 50 and 20 is 10 and 545% gcd(50, 20)=5≠0;

If the user-input amount is 550, firstly $550<(50\cdot 12+20\cdot 10)=900$, further the banknote-dispensing result is calculated as $50X_1+20X_2=M$, divide both sides of $50X_1+20X_2=M$ by gcd(50, 20) to obtain $5X_1+2X_2=m$ on the assumption that M/gcd(50, 20)=m, thus:

$$\begin{bmatrix}1 & 0 & 5\\ 0 & 1 & 2\end{bmatrix} \rightarrow \begin{bmatrix}1 & 0 & 5\\ 0 & 1 & 2\\ 1 & -2 & 1\end{bmatrix} \rightarrow \begin{bmatrix}1 & 0 & 5\\ 0 & 1 & 2\\ 1 & -2 & 1\\ m & -2m & m\end{bmatrix},$$

$X_1=m+2t$ and $X_2=-2m-5t$ may be obtained;

In the case of M=550, m=55, that is, $X_1=55+2t$ and $X_2=110-5t$. The range of t may be determined as $-24\le t\le 22$ by obtaining $0\le X_1\le 12$, $0\le X_2\le 10$ from $0\le X_1\le S_1$, $0\le X_2\le S_2$.

If the average method is used for banknote-outputting, then $X_1\approx X_2$, that is, $55+2t=-110-5t+\sigma \Rightarrow 7t=-165+\sigma$ where $|\sigma|$ is as small as possible. Further since $-168\le 7t\le -154$, the demanded banknote-dispensing scheme is $t=-24$, $\sigma=-3$, $X_1=7$, $X_2=10$.

If the average-emptying method is used, then $X_1-X_2\approx 12-10+\sigma=2+\sigma$ where $|\sigma|$ is as small as possible, that is, $163+7t=\sigma$, further since $-24\le t\le -22$, the demanded banknote-dispensing scheme is $t=-23$, $\sigma=2$, $X_1=9$, $X_2=5$.

If the number minimum method is used, then $(X_1+X_2)$ is as small as possible and $(-55-3t)$ is as small as possible, and $X_1=11$, $X_2=0$, $t=-22$ is obtained as the demanded banknote-dispensing scheme further since $-24\le t\le -22$.

If the maximum-denomination priority method is used, $X_i$ is as great as possible, and $55+2t$ is as great as possible, and $t=-22$, $X_1=11$, $X_2=0$ are obtained as the demanded banknote-dispensing scheme further since $-24\le t\le -22$.

If the minimum-denomination priority method is used, $X_2$ is as great as possible, and $-110-5t$ is as great as possible, and $t=24$, $X_1=7$, $X_2=10$ are obtained as the demanded banknote-dispensing scheme further since $-24\le t\le -22$.

Third Embodiment

Figure 4:
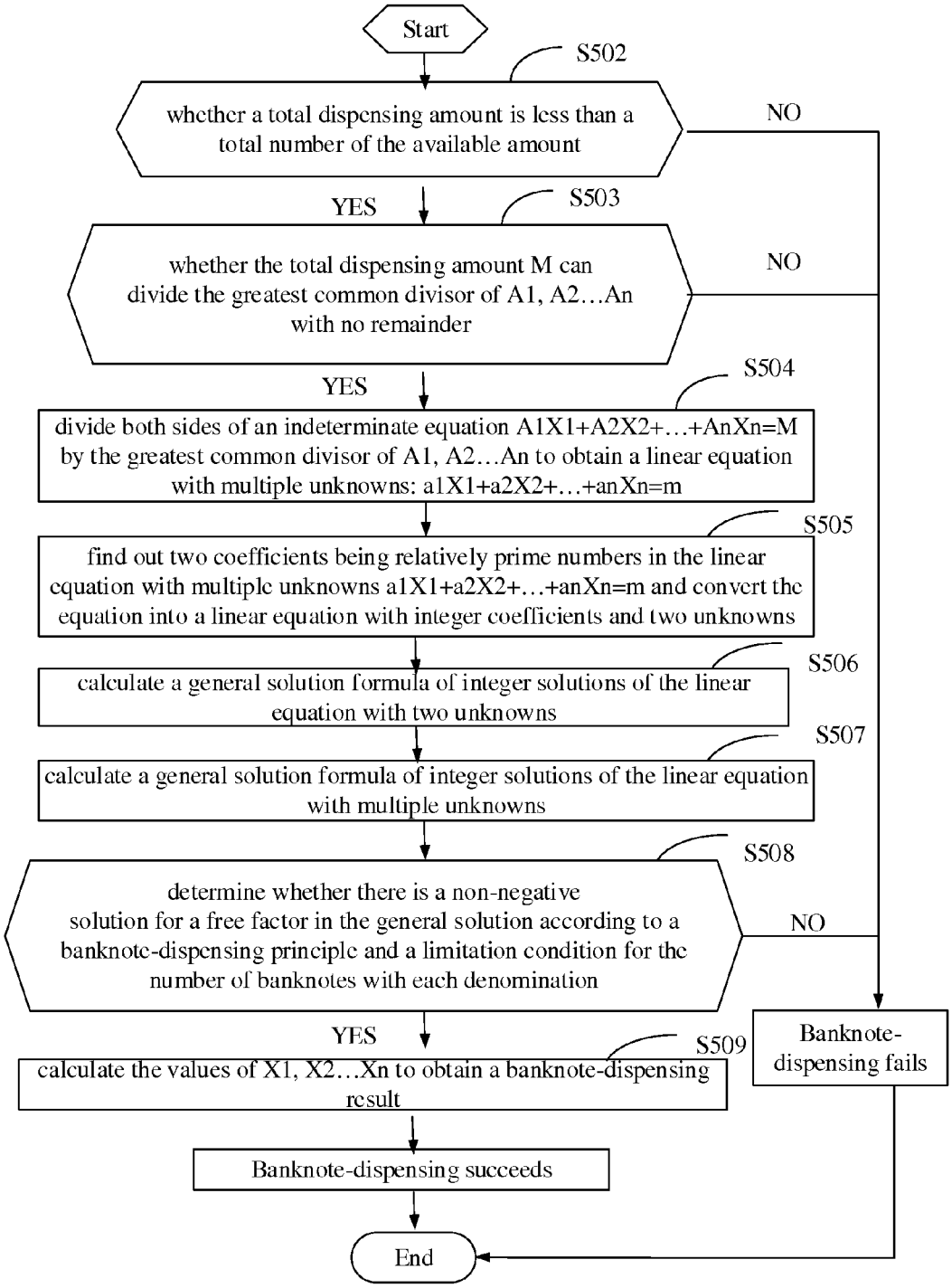
FIG. 4 is a flowchart of a banknote-dispensing algorithm in a case of three or more denominations according to the present invention.

Referring to FIG. 4, it shows is a whole banknote-dispensing process of a self-service equipment in the case where there are n denomination values available in the self-service equipment and n is not less than 2. The process including:

S502: judging whether a dispensing amount is not greater than a total number of available amount in banknote-boxes of the self-service equipment, if yes, proceeding to step S503; otherwise, the banknote-dispensing fails and the process ends.

S503: calculating the greatest common divisor of the denomination values and judging whether the greatest common divisor of the denomination values can divide the dispensing amount with no remainder, if yes, proceeding to step S504; otherwise, the banknote-dispensing fails and the process ends.

S504: judging whether the greatest common divisor of the denomination values, $\gcd(A_1, A_2 \ldots A_n)$, is greater than 1, if $\gcd(A_1, A_2 \ldots A_n)$ is greater than 1, dividing both sides of $$\sum_{i=1}^{n} A_i X_i = M$$

by $\gcd(A_1, A_2 \ldots A_n)$ to obtain an linear indeterminate equation with integer coefficients and n unknowns:

$$\sum_{i=1}^{n} a_i X_i = m$$

where $\gcd(a_1,a_2, \ldots, a_n)=1$ and $M=m\gcd(A_1, A_2 \ldots A_n)$; otherwise, keeping $$\sum_{i=1}^{n} A_i X_i = M$$

as it is.

S505: in the linear indeterminate equation with integer coefficients and n unknowns:

$$\sum_{i=1}^{n} a_i X_i = m,$$

if there are two relatively prime coefficients: 1 in $a_1, a_2, \ldots, a_n$, then proceeding to S506; otherwise, the equation is converted into an equivalent linear equation with n unknowns having two relatively prime coefficients according to the following method:

since absolute values of $a_1, a_2, \ldots, a_n$ are greater than 1, finding out one coefficient with the smallest absolute value and letting $a_1>0$, then other coefficients may be represented as $a_i=k_i a_1+r_i$, $0\le r_i<a_1$ (i=2, 3, . . . n); and the original equation may be converted into $a_1(x_1+k_2x_2+ \ldots +k_nx_n)+r_2x_2+r_3x_3+ \ldots +r_nx_n=M$; if there are certain two coefficients in $a_1, r_2, r_3, \ldots r_n$ being relatively prime, proceeding to step S506; if any two coefficients in $a_1, r_2, r_3, \ldots r_n$ are not relatively prime, further finding out the smallest coefficient therein, representing other coefficients with the smallest coefficient and converting once more until there are two coefficients being relatively prime. For example, $6x+10y+15z=1170$ may be converted into $6(x+y+2z)+4y+3z=1170$, let $u=x+y+2z$, then $6u+4y+3z=1170$, where the coefficient of y, 4, and the coefficient of z, 3, are relatively prime.

S506: since there are two coefficients relatively prime for the linear equation with multiple unknowns, let $(a_1,a_2)=1$, then $a_1X_1+a_2X_2=m-(a_3X_3+ \ldots +a_nx_n)$. If one of particular solutions of $a_1X_1=a_2X_2=1$ is $$\begin{cases} X_{01} \\ X_{02} \end{cases},$$

the method for calculating the particular solution of $a_1X_1+a_2X_2=1$ can be referred to the banknote-dispensing method for two denominations in the above S4.

S507: a general solution formula of the linear indeterminate equation with integer coefficients and n unknowns:

$$\sum_{i=1}^{n} a_i X_i = m$$

$((a_1, a_2)=1)$ is:

$$\begin{cases} X_1 = X_{01}[m-(a_3X_3+\ldots+a_nX_n)]+a_2t \\ X_2 = X_{02}[m-(a_3X_3+\ldots+a_nX_n)]-a_1t \end{cases},$$

where, $t, x_3, x_4, \ldots, x_n \in Z$.

It can be seen that, under a premise that there are solutions for the linear indeterminate equation with n unknowns, if there is the greatest common divisor of two coefficients which is 1, then the general solution of the equation contains n−1 parameters, where n−2 parameters may be taken from original arguments.

S508: the range of integer t, $[t_1,t_2]$, may be calculated according to $0 \le X_1 \le S_1$, $0 \le X_2 \le S_2 \ldots 0 \le X_n \le S_n$ ($S_1, S_2 \ldots S_n$ are numbers of the available banknotes with the denominations).

S509: further limiting the values of $X_1$ and $X_2$ according to a banknote-dispensing principle, and the value of t in the range $[t_1, t_2]$ may be determined in the following cases according to different banknote-dispensing principles:

S51) an average method, where $X_1 \approx X_2 \approx \ldots \approx X_n$ and $$\Delta x = \sum_{j=1}^{n} \left( \left| X_j - \frac{1}{n} \sum_{i=1}^{n} X_i \right| \right)$$

takes a minimum value;

S52) an average-emptying method, where $X_1 - S_1 \approx X_2 - S_2 \approx \ldots \approx Xn - Sn$ and $$\Delta x = \sum_{j=1}^{n} \left( \left| (X_j - S_j) - \frac{1}{n} \sum_{i=1}^{n} (X_i - S_i) \right| \right)$$

takes a minimum value;

S53) a number minimum method, where $$\sum_{i=1}^{n} X_i$$

is as small as possible, that is, $$\min\left( \sum_{i=1}^{n} X_i \right)$$

is calculated;

S54) a minimum-denomination priority method, where if is $A_i$ is a smallest denomination of all denominations, $X_i$ is as great as possible;

S55) a maximum-denomination priority method, where if is $A_i$ is a greatest denomination of all denominations, $X_i$ is as great as possible.

In the embodiment shown in FIG. 4, if any two coefficients in the coefficients of the linear indeterminate equation with integer coefficients and n unknowns, $$\sum_{i=1}^{n} a_i X_i = m,$$

are not relatively prime, that is, the greatest common divisor is not 1, then absolute values of $a_1, a_2, \ldots, a_n$ are greater than 1. Let $a_1$ be the one with the smallest absolute value and $a_1 > 0$, take $a_1$ is a divisor, then $a_i = k_i a_1 + r_i$, $0 \le r_i < a_1$ (i=2, 3, . . . n); and the original equation may be converted into $a_1(x_1 + k_2 x_2 + \ldots + k_n x_n) + r_2 x_2 + r_3 x_3 + \ldots + r_n x_n = m$. If there are certain two coefficients being relatively prime in $a_1, r_2, r_3, \ldots, r_n$, the equation may be calculated in the above method; if any two coefficients in $a_1, r_2, r_3, \ldots, r_n$ are not relatively prime, the equation is converted once more until there are two coefficients being relatively prime.

In the embodiment shown in FIG. 4, for example, suppose that four denominations: 100, 50, 20 and 15 are provided in the self-service equipment, that is, $A_1=100$, $A_2=50$, $A_3=20$, $A_4=15$. The numbers of the available banknotes are $S_1=15$, $S_2=10$, $S_3=18$, $S_4=20$ respectively. If an amount input by a user is 1565, since the greatest common divisor of 100, 50, 20 and 15 is 5 and 1565% gcd(100,50,20,5)=0, $20X_1+10X_2+4X_3+3X_4=313$ is obtained by dividing both sides of $100X_1+50X_2+20X_3+15X_4=1565$ by 5. Since coefficients of $X_3$ and $X_4$ are relatively prime, the equation becomes a linear equation with two unknowns: $4X_3+3X_4=313-20X_1-10X_2$. Since the general solution of $4X_3+3X_4=1$ is:

$$\begin{cases} X_3 = -5 + 3t \\ X_4 = 7 - 4t \end{cases} (t \in Z),$$

the general solution of $4X_3+3X_4=313-20X_1-10X_2$ is:

$$\begin{cases} X_3 = -5(313 - 20X_1 - 10X_2) + 3t \\ X_4 = 7(313 - 20X_1 - 10X_2) - 4t \end{cases} (t, X_1, X_2 \in Z)$$

$-87 \le 313 - 20X_1 - 10X_2 \le 313$ may be obtained by obtaining $0 \le X_1 \le 15$, $0 \le X_2 \le 10$, $0 \le X_3 \le 18$, $0 \le X_4 \le 20$ according to $0 \le X_1 \le S_1$, $0 \le X_2 \le S_2$, $0 \le X_3 \le S_3$, $0 \le X_4 \le S_4$ and $S_1=15$, $S_2=10$, $S_3=18$, $S_4=20$, so as to determine the range of t as $-145 \le t \le 527$.

1) if the average method is used, then $X_1 \approx X_2 \approx X_3 \approx X_4$, and according to $$\Delta x = \sum_{j=1}^{n} \left( \left| X_j - \frac{1}{n} \sum_{i=1}^{n} X_i \right| \right),$$

$$\Delta x = \left| X_1 - \frac{X_1 + X_2 + X_3 + X_4}{4} \right| + \left| X_2 - \frac{X_1 + X_2 + X_3 + X_4}{4} \right| + \left| X_3 - \frac{X_1 + X_2 + X_3 + X_4}{4} \right| + \left| X_4 - \frac{X_1 + X_2 + X_3 + X_4}{4} \right|$$

is the smallest, that is, $-5(313-20X_1-10X_2)+3t \approx 7(313-20X_1-10X_2)-4t \approx X_1 \approx X_2$. Thus t=108, $X_1=8$, $X_2=9$, $X_3=9$, $X_4=9$, $\Delta x=1.5$ is obtained as the demanded banknote-dispensing scheme (8, 9, 9, 9).

If the average-emptying method is used, then $X_1 - S_1 \approx X_2 - S_2 \approx X_3 - S_3 \approx X_4 - S_4$, according to a minimum value of $$\Delta x = \sum_{j=1}^{n} \left( \left| (X_j - S_j) - \frac{1}{n} \sum_{i=1}^{n} (X_i - S_i) \right| \right),$$

t=159, $X_1=9$, $X_2=4$, $X_3=12$, $X_4=15$, $\Delta x=1.5$ is obtained as the demanded banknote-dispensing scheme, and original numbers of denominations are (15, 10, 18, 20) and the numbers (6, 6, 6, 5) are available after outputting the banknotes.

3) if the number minimum method is used, then $(X_1+X_2+X_3+X_4)$ is as small as possible, that is, $(626-39X_1-19X_2-t)$ is as small as possible, the minimum number is obtained as 17 pieces by calculating $\min(626-39X_1-19X_2-t)=17$, thus $t=5$, $X_1=15$, $X_2=1$, $X_3=0$, $X_4=1$ is the demanded banknote-dispensing scheme (15, 1, 0, 1).

4) if the maximum-denomination priority method is used, then $X_1$ is as great as possible, $X_2$ is as great as possible secondly and $X_3$ is as great as possible thirdly, and $t=5$, $X_1=15$, $X_2=1$, $X_3=0$, $X_4=1$ is obtained as the demanded banknote-dispensing scheme (15, 1, 0, 1).

5) if the minimum-denomination priority method is used, then $X_4$ is as great as possible, $X_3$ is as great as possible secondly and $X_2$ is as great as possible thirdly, and $t=193$, $X_1=5$, $X_2=10$, $X_3=14$, $X_4=19$ is obtained as the demanded banknote-dispensing scheme (5, 10, 14, 19), where original numbers of denominations are (15, 10, 18, 20) and the numbers (10, 0, 4, 1) are available for each denomination after outputting the banknotes.

In summary, the banknote-dispensing method provided in the present invention is meaningful in real life. After each time an ATM finishes banknote-clearing, or a banknote-box of a certain denomination locks banknotes or a clearing-up leads to that the ATM can not provide the banknote with such denomination, a configuration of banknote-dispensing algorithm is performed. In this case, the number of banknote-boxes in the ATM and the number of denomination types in the ATM have been determined. When a banknote-dispensing calculation is performed, by calculating all feasible banknote-dispensing methods rapidly, under any banknote-dispensing principle and a limiting condition of the number of the available banknotes, whether there is a banknote-dispensing method under such special condition is found out and the banknote-dispensing with high-speed and high-efficiency is achieved. The method has advantages of direct-viewing, high-efficiency, speediness and preciseness, and by the method all banknote-dispensing schemes can be found quickly without using the exhaustive search. By the method, since there is a mathematical logic relation between all banknote-dispensing schemes, any feasible banknote-dispensing scheme found out can not be omitted.

At the present time, there are mainly five types of banknote-dispensing principles: an average-emptying method in which the available banknotes with all the denominations are emptied with approximately the same probability; an average method in which banknotes are output according to a banknote-dispensing scheme in which the numbers of banknotes with each denomination is approximately equal; a maximum-denomination priority method in which banknotes with a great denomination are output preferably and a total number of banknotes to be output may be not always minimum in accordance with the scheme; a minimum-denomination priority method in which banknote-outputting is performed according to a banknote-dispensing scheme that the total number of banknotes to be output is maximum; and a total number minimum method banknote-outputting is performed according to a banknote-dispensing scheme in which the total number of banknotes to be output is minimum.

It should be noted that embodiments shown from FIG. 1 to FIG. 4 are only preferable embodiments described in the present invention. More embodiments may be designed by those skilled in the art on the basis of the above embodiments, and will not be described herein.

Numerous modifications to the embodiments will be apparent to those skilled in the art, and the general principle herein can be implemented in other embodiments without deviation from the spirit or scope of the present invention. Therefore, the present invention will not be limited to the embodiments described herein, but in accordance with the widest scope consistent with the principle and novel features disclosed herein.

The invention claimed is:

1. A method for a financial self-service equipment to dispense banknotes, comprising:

acquiring a total dispensing amount input into the equipment by a user;

acquiring denomination values of available banknotes in the self-service equipment;

acquiring the number of available banknotes corresponding to each denomination value; via a calculation section of the equipment;

determining via said calculation section a total available amount in the self-service equipment according to the denomination values and the number of the available banknotes;

establishing a relation between the denomination values, the number of the available banknotes corresponding to each denomination value and the total dispensing amount that is represented by the following equation processed by the calculation section:

$$\sum_{i=1}^{n} A_i X_i = M,$$

in the case where the total available amount is not less than the total dispensing amount and the greatest common divisor of the denomination values available in the self-service equipment can divide the total dispensing amount with no remainder, where $A_i$ is the denomination values, $X_i$ is an unknown number of banknotes to be output corresponding to $A_i$, n is a total number of the denomination value types and is not less than 2, and M is the total dispensing amount;

dividing both sides of the equation $$\sum_{i=1}^{n} A_i X_i = M$$

by the greatest common divisor of the n denomination values, $\gcd(A_1, A_2 \ldots A_n)$, in the case where $\gcd(A_1, A_2 \ldots A_n)$ is not 1, to obtain a linear indeterminate equation with integer coefficients and n unknowns, $$\sum_{i=1}^{n} a_i X_i = m,$$

where $a_i$ is a quotient from dividing $A_i$ by $\gcd(A_1, A_2 \ldots A_n)$ and m is a quotient from dividing M by $\gcd(A_1, A_2 \ldots A_n)$;

calculating a general solution of the linear indeterminate equation with integer coefficients and n unknowns:

$$\sum_{i=1}^{n} a_i X_i = m \text{ as } \begin{cases} X_1 = X_{01}[m-(a_3X_3+\ldots+a_nX_n)]+a_2t \\ X_2 = X_{02}[m-(a_3X_3+\ldots+a_nX_n)]-a_1t \end{cases},$$

where $t, x_3, x_4, \ldots, x_n \in Z$ and $\gcd(a_1, a_2)=1$;

calculating a particular solution $(X_{01}, X_{02})$;

calculating out a set of all t satisfying $0 \le X_1 \le S_1$, $0 \le X_2 \le S_2 \ldots 0 \le X_n \le S_n$ according to the general solution of $$\sum_{i=1}^{n} a_i X_i = m$$

and the particular solution of $$\sum_{i=1}^{n} a_i X_i = m:$$

($X_{01}$, $X_{02}$), where $S_1$, $S_2$ . . . $S_n$ are the numbers of the available banknotes corresponding to the denomination values;

determining the range of t in set A according to a preset banknote-dispensing principle corresponding to $X_1$, $X_2$ . . . $X_n$; and substituting t in the general solution above by an integral t to calculate out the values of $X_1$, $X_2$ . . . $X_n$, and outputting $X_1$, $X_2$ . . . $X_n$ numbers of banknotes with the denomination values $A_1$, $A_2$ . . . $A_n$ by the self-service equipment.

2. The method for a financial self-service equipment to dispense banknotes according to claim 1, wherein, the preset banknote-dispensing principle is an average method.

3. The method for a financial self-service equipment to dispense banknotes according to claim 1, wherein the preset banknote-dispensing principle is an average-emptying method.

4. The method for a financial self-service equipment to dispense banknotes according to claim 1, wherein the preset banknote-dispensing principle is a number minimum method.

5. The method for a financial self-service equipment to dispense banknotes according to claim 1, wherein the preset banknote-dispensing principle is a maximum-denomination priority method.

6. The method for a financial self-service equipment to dispense banknotes according to claim 1, wherein the preset banknote-dispensing principle is a minimum-denomination priority method.

7. The method for a financial self-service equipment to dispense banknotes according to claim 1, wherein, in the case where the total available amount is less than the total dispensing amount or there is no integer t, the method further comprises:

acquiring available denomination values and the number of banknotes corresponding to each available denomination value of other self-service equipments connected to a network, via a database by the self-service equipment;

determining a specific address of a self-service equipment that conforms to a preset condition where the total available amount is not less than the total dispensing amount or there is an integer t; and displaying the specific address.

8. The method for a financial self-service equipment to dispense banknotes according to claim 1, wherein, in the case where the number of the available denomination values in the self-service equipment is not less than 3, and $a_1$ and $a_2$ are not relatively prime numbers, before calculating the general solution of the linear indeterminate equation with integer coefficients and n unknowns, $$\sum_{i=1}^{n} a_i X_i = m,$$

the method further comprises:

converting the linear indeterminate equation with integer coefficients and n unknowns:

$$\sum_{i=1}^{n} a_i X_i = m$$

into an equivalent linear equation with n unknowns: $a_1X_1+a_2X_2=m-(a_3X_3+ \ldots +a_nx_n)$, wherein one particular solution of $a_1X_1+a_2X_2=1$ is $$\begin{cases} X_{01} \\ X_{02} \end{cases},$$

and $\gcd(a_1, a_2)=1$.

9. The method for a financial self-service equipment to dispense banknotes according to claim 8, wherein, the preset banknote-dispensing principle is an average method.

10. The method for a financial self-service equipment to dispense banknotes according to claim 8, wherein the preset banknote-dispensing principle is an average-emptying method.

11. The method for a financial self-service equipment to dispense banknotes according to claim 8, wherein the preset banknote-dispensing principle is a number minimum method.

12. The method for a financial self-service equipment to dispense banknotes according to claim 8, wherein the preset banknote-dispensing principle is a maximum-denomination priority method.

13. The method for a financial self-service equipment to dispense banknotes according to claim 8, wherein the preset banknote-dispensing principle is a minimum-denomination priority method.

* * * * *